US006761122B2

(12) United States Patent
Nakagawa et al.

(10) Patent No.: US 6,761,122 B2
(45) Date of Patent: Jul. 13, 2004

(54) STAND-UP TYPE PERSONAL WATERCRAFT

(75) Inventors: Kenichi Nakagawa, Kobe (JP); Yoshiyuki Kuroyanagi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/318,924

(22) Filed: Dec. 12, 2002

(65) Prior Publication Data

US 2003/0127032 A1 Jul. 10, 2003

(30) Foreign Application Priority Data

Jan. 7, 2002 (JP) ..... 2002-000646

(51) Int. Cl.[7] ..... B63B 35/73
(52) U.S. Cl. ..... 114/55.56; 114/197; 440/88 N
(58) Field of Search ..... 114/55.5, 55.51, 114/55.56, 185, 197; 440/38, 88 C, 88 N; 137/270

(56) References Cited

U.S. PATENT DOCUMENTS 2,730,062 A * 1/1956 Mitchell ..... 114/185
2,888,897 A * 6/1959 Pribyl ..... 114/185
3,004,511 A * 10/1961 Moeller ..... 114/185
3,036,541 A * 5/1962 Musick et al. ..... 114/197
3,400,683 A * 9/1968 De Forest ..... 114/185
3,565,031 A * 2/1971 DePersia et al. ..... 114/197
4,019,454 A * 4/1977 Landwerlen ..... 114/197
4,542,373 A * 9/1985 Hillock ..... 114/197
4,676,759 A * 6/1987 Murase ..... 114/55.51
5,047,753 A * 9/1991 Birchfield ..... 114/197
5,048,556 A * 9/1991 Grumelot et al. ..... 114/197
6,050,867 A * 4/2000 Shields et al. ..... 114/197
6,244,913 B1 * 6/2001 Matsumoto et al. ..... 440/38

* cited by examiner

*Primary Examiner*—S. Joeseph Morano
*Assistant Examiner*—Lars A. Olson
(74) *Attorney, Agent, or Firm*—Kolisch Hartwell, P.C.

(57) ABSTRACT

Disclosed is a stand-up type personal watercraft capable of easily discharging water in an engine room of a body that is limited in space even when the watercraft is beached. The stand-up type personal watercraft comprises a bulkhead 12 that defines an engine room 10 in the body 2 surrounded by a hull 3 and a deck 4; a water intake 16 formed in the hull 3, through which water is sucked by a water jet pump; a penetrating hole 26 formed in a lower portion of the bulk head 12; a fitting member 27 mounted to the penetrating hole 26, a plug 28 removably attached to the fitting member 27; a hollow drain plug 24 provided at the periphery of the water intake 16, for mounting the grate plate 19; and a hose 29 connecting the fitting member 27 to the drain plug 24.

12 Claims, 7 Drawing Sheets

STAND-UP TYPE PERSONAL WATERCRAFT

BACKGROUND OF THE INVENTION

1. Field of the Invention

The present invention relates to a stand-up type personal watercraft (PWC). More particularly, the present invention relates to a personal watercraft steered by a rider who operates a steering handle standing on a floor at a rear portion of a deck.

2. Description of the Related Art

In recent years, so-called stand-up type personal watercraft have been used in leisure, sport activities, and the like. The stand-up type personal watercraft is provided with a flat floor called a standing deck at a rear portion of a deck of the watercraft. The rider stands on the floor and operates a steering handle located in front of the floor. In general, one rider rides on the stand-up type personal watercraft.

As a propulsion mechanism, a water-jet propulsion device is used. Specifically, the personal watercraft is configured to have a water jet pump that pressurizes and accelerates water sucked from a water intake generally provided on a hull bottom surface and ejects it rearward from an outlet port. Thereby, the watercraft is propelled. In this personal watercraft, an engine is contained in a body constituted by a deck and a hull. An engine room which contains the engine is formed in a front space separated by a bulkhead in the longitudinal direction of the body.

The rider enjoys active steering while the personal watercraft is planing on a water surface. Sometimes, during cruising, water ingress into the engine room occurs. For the purpose of discharging the water in the engine room, the conventional stand-up type personal watercraft is provided with a bilge discharge mechanism obtained by connecting the engine room to the water jet pump by means of a pipe member. The bilge discharge mechanism serves to discharge the water in the engine room to outside the watercraft by a function of the water jet pump.

However, the bilge discharge mechanism functions only while the watercraft is cruising, i.e., the water jet pump is operating, and does not function when the watercraft is beached. With this bilge discharge mechanism, it is therefore difficult to discharge the water remaining in the engine room when the watercraft stops cruising and is beached. When the watercraft is beached, the water remaining in the space-limited engine room is commonly discharged through an operator's manual effort using a sponge, a hand-operated pump, or the like. This work is troublesome.

SUMMARY OF THE INVENTION

The present invention addresses the above-described conditions and an object of the present invention is to provide a stand-up type personal watercraft comprising a discharge mechanism capable of easily discharging water from an engine room of a body of the watercraft even when the watercraft is beached.

According to the present invention, there is provided a stand-up type personal watercraft comprising: an engine; a body constituted by a deck and a hull; an engine room for containing the engine; a bulkhead that defines a front portion of the body as the engine room for containing the engine; and a drain passage formed in a lower portion of the engine room so as to communicate with an outside of the watercraft, wherein the drain passage is adapted to be opened/closed.

With such a configuration, when the watercraft is not cruising, for example, when the watercraft is beached, the water can be easily discharged. As defined herein, the lower portion of the engine room includes a bottom portion of the engine room.

Preferably, the stand-up type personal watercraft may further comprise: a water jet pump driven by the engine; and a water intake formed in the hull, from which water is sucked by the water jet pump, and one end of the drain passage is opened in the vicinity of the water intake.

Preferably, the stand-up type personal watercraft may further comprises a grate plate, wherein a concave portion for mounting the grate plate may be formed in a portion of the hull at a periphery of the water intake, a first penetrating hole is formed in the concave portion and a second penetrating hole is formed in a lower portion of the bulkhead, and the drain passage may be formed such that the first penetrating hole and the second penetrating hole are connected to each other by a first pipe member.

With such a configuration, the drain mechanism is provided by using the existing structure, i.e., the concave portion for mounting the grate plate, without substantially changing the shape of the planing surface of the hull, which is an important factor in cruising. Advantageously, the drain mechanism is attained by simply connecting the penetrating holes to each other by means of the first pipe member.

Preferably, the drain passage may have an openable closing member in at least one of an end portion thereof on the concave portion side and an end portion thereof on the bulk head side.

The end portion on the concave portion side or the end portion on the bulkhead side, where the operator can easily open/close the closing member, can be selected.

Preferably, the end portion of the drain passage on the concave portion side may be opened, the drain passage may have the closing member in the end portion thereof on the bulkhead side, and the watercraft may comprise: a transmission member connected to the closing member and extending to the deck, for opening/closing the closing member; and an operation member mounted to the deck, for operating the transmission member.

In this structure, remote operation that makes it easy to open/close the drain mechanism becomes possible by providing the operation member in an operation panel or the like in front of the rider.

Preferably, the stand-up type personal watercraft may further comprise a fastening member provided for mounting the grate plate to a portion of the hull at a periphery of the water intake, the fastening member may be comprised of a second pipe member having a penetrating hole inside thereof and mounted to the concave portion and a drain plug removably attached in the penetrating hole of the second pipe member with the grate plate retained between the end portion of the second pipe member and the drain plug, and one end portion of the first pipe member may be connected to the second pipe member.

In this structure, the drain mechanism is provided by using the fastening member of the grate member without substantially changing the existing external appearance of the watercraft.

Preferably, the drain passage may have an openable closing member in an end portion thereof on the bulkhead side, and the plug may have a hollow portion through which an inside of the second pipe member communicates with an outside of the watercraft.

With such a configuration, since the end portion of the drain passage located in the vicinity of the periphery of the water intake is opened and the end portion of the drain passage on the bulk head side is openable/closable, the operator need not get under the hull and open/close the drain passage when discharging the water.

The above and further objects and features of the invention will be more fully be apparent from the following detailed description with accompanying drawings.

DETAILED DESCRIPTION OF THE PREFERRED EMBODIMENTS

Hereinafter, embodiments of a stand-up type personal watercraft (hereinafter referred to as a personal watercraft or a watercraft) of the present invention will be described with reference to the accompanying drawings.

Figure 1:
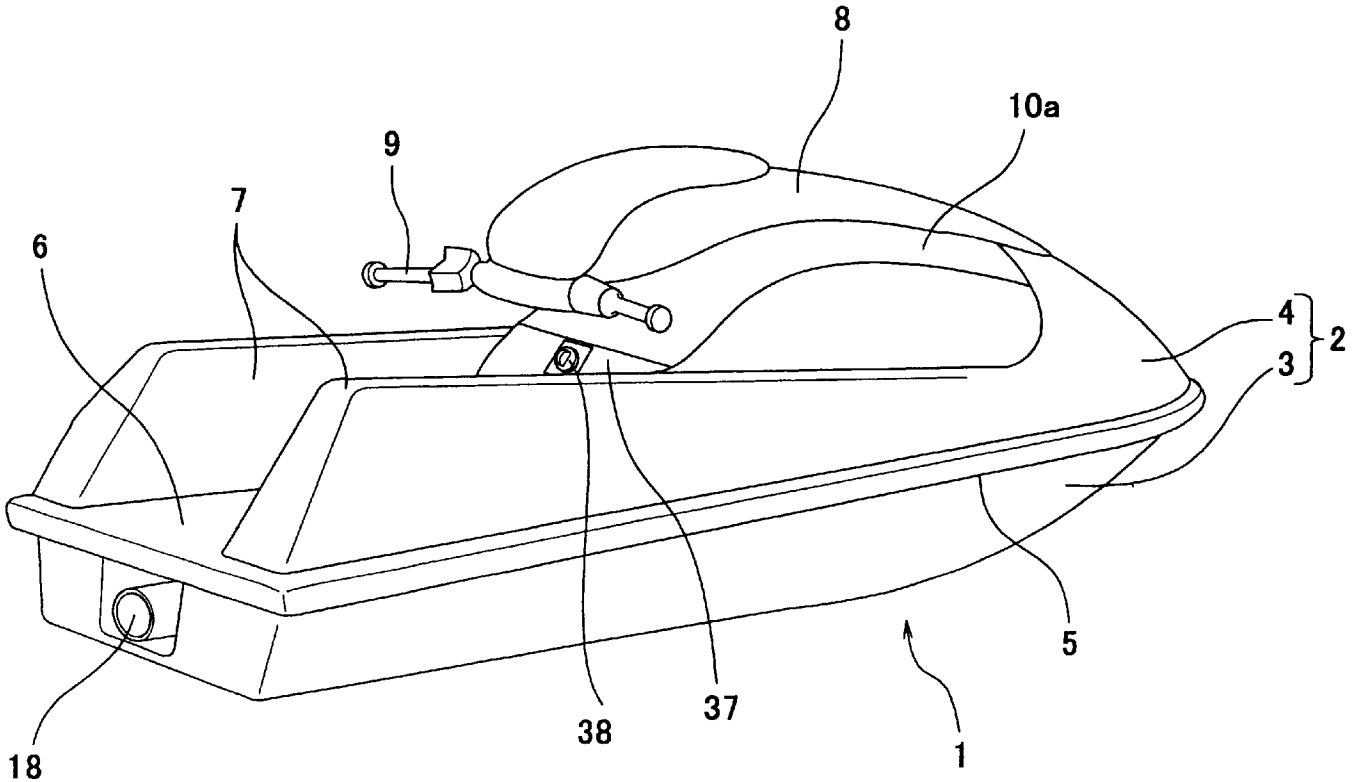
FIG. 1 is a perspective view showing an embodiment of a personal watercraft according to the present invention.
Figure 2:
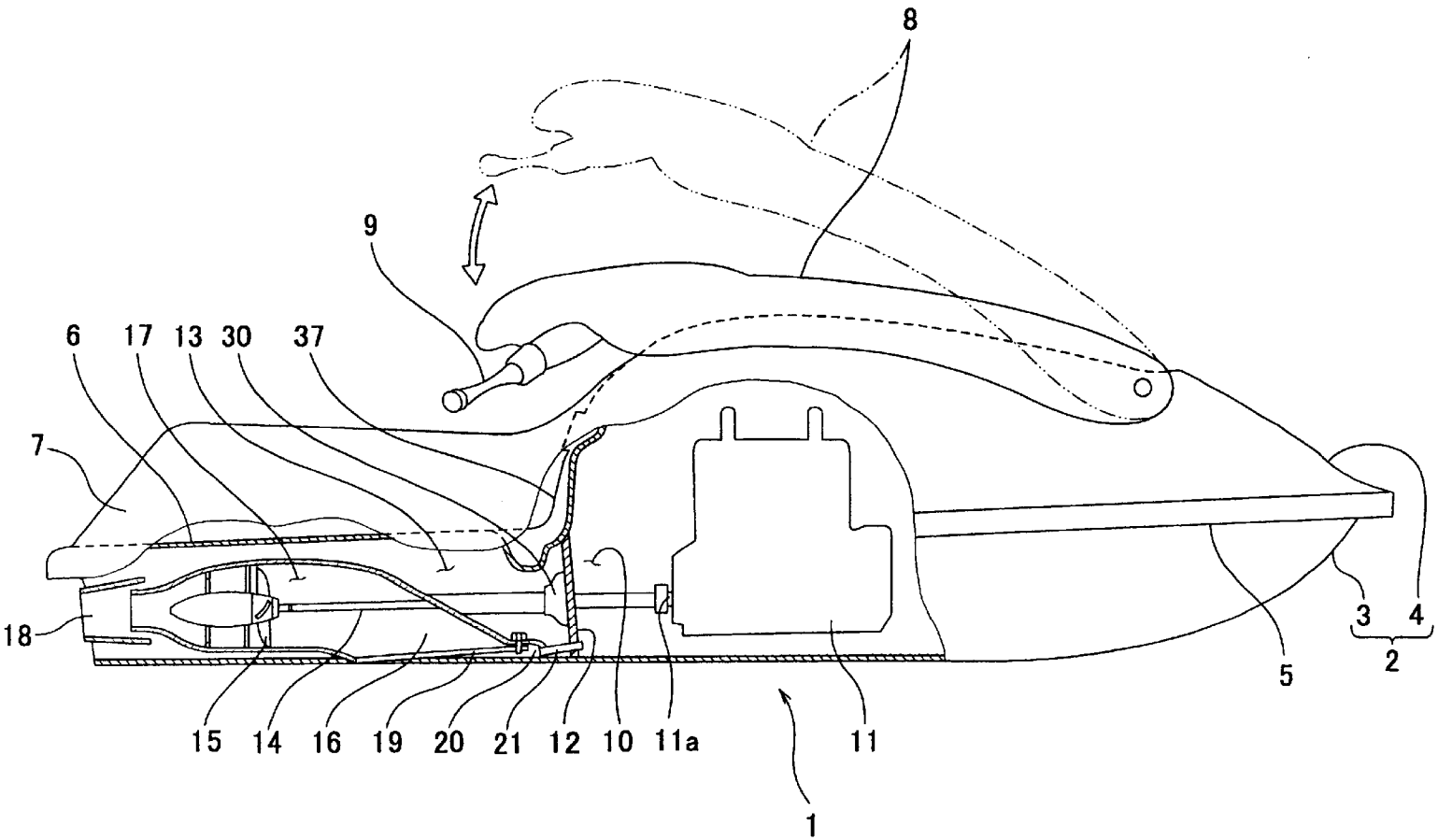
FIG. 2 is a partially cutaway side view of the personal watercraft in FIG. 1.

Referring to FIGS. 1 and 2, a personal watercraft 1 is a stand-up type personal watercraft propelled by a water jet pump. In the watercraft 1, reference numeral 2 denotes a body. The body 2 comprises a hull 3 and a deck 4 covering the hull 3 from above. A line at which the hull 3 and the deck 4 are connected over the entire perimeter thereof is called a gunnel line 5.

A standing deck 6 as a concave portion having a flat floor on which a rider stands is provided from the center portion to the rear portion of the deck 4. Convex wall portions (deck fins) 7 are provided on right and left sides of the standing deck 6. A steering member (handle pole) 8 is mounted onto the deck 4 forward of the standing deck 6 so as to be vertically pivotable around its front portion as a support point (as indicated by the two-dot chain line in FIG. 2). A bar-type steering handle 9 is attached to a tip end of the handle pole 8. Standing on the standing deck 6, the rider grips the steering handle 9 and steers the watercraft 1 while raising the handle pole 8.

As shown in FIG. 2, an engine 11 is disposed in a space (engine room) 10 in the body 2 surrounded by the hull 3 and the deck 4 below the handle pole 8. The engine room 10 is separated from a rear space 13 by a bulk head 12 in the body 2. A propeller shaft 14 connected to an output shaft 11*a* of the engine 11 extends through the bulk head 12 and into the rear space 13. In the rear space 13, an impeller 15 is attached to the propeller shaft 14 so as to be rotatably driven by the engine 11. Reference numeral 10*a* denotes an engine hood.

Figure 3:
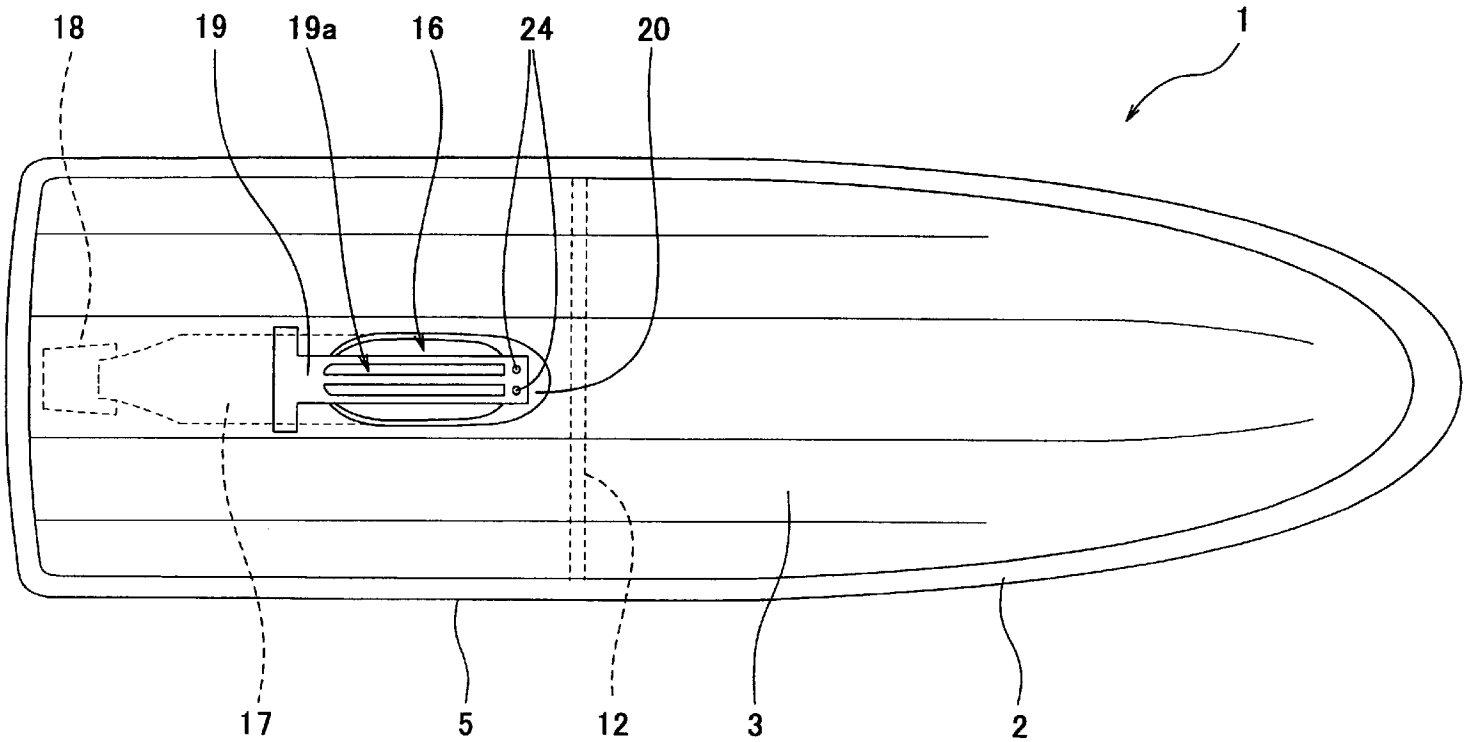
FIG. 3 is a bottom view of the personal watercraft in FIG. 1.

As should be appreciated from FIGS. 2 and 3, a water intake 16 is provided at the hull 3 in the rear space 13 and a water intake passage 17 is provided inside of the rear space 13. Through the water intake passage 17, the water sucked from the water intake 16 flows to the stern. The impeller 15 is placed in the water intake passage 17. The water sucked from the water intake 16 is pressurized by the impeller 15 and ejected through a pump nozzle 18 located behind the impeller 15 and, as a reaction of the ejecting water, the body 2 obtains a propulsion force.

A grate plate 19 is mounted to the water intake 16. The grate plate 19 is generally formed in the shape of nets, meshes, or the like. In this embodiment, as shown in FIG. 3, the grate plate 19 has a plurality of slits 19*a* through which the water flows. The periphery of the water intake 16 in the hull 3 is shaped to have a concave portion 20 to accommodate the grate plate 19. Reference numeral 24 denotes bolts with which the grate plate 19 is mounted.

The water flowing into the engine room 10 during cruising of the watercraft 1 is discharged from the stern outside the watercraft by a bilge discharge mechanism (not shown) utilizing a function of the water jet pump. However, since the bilge discharge mechanism does not function when the watercraft 1 is landed, a drain mechanism 21 (see FIG. 2) provided at a lower end of a rear portion of the engine room 10 is used to discharge the water.

Hereinafter, the drain mechanism 21 will be described with reference to FIGS. 4 to 6.

Figure 4:
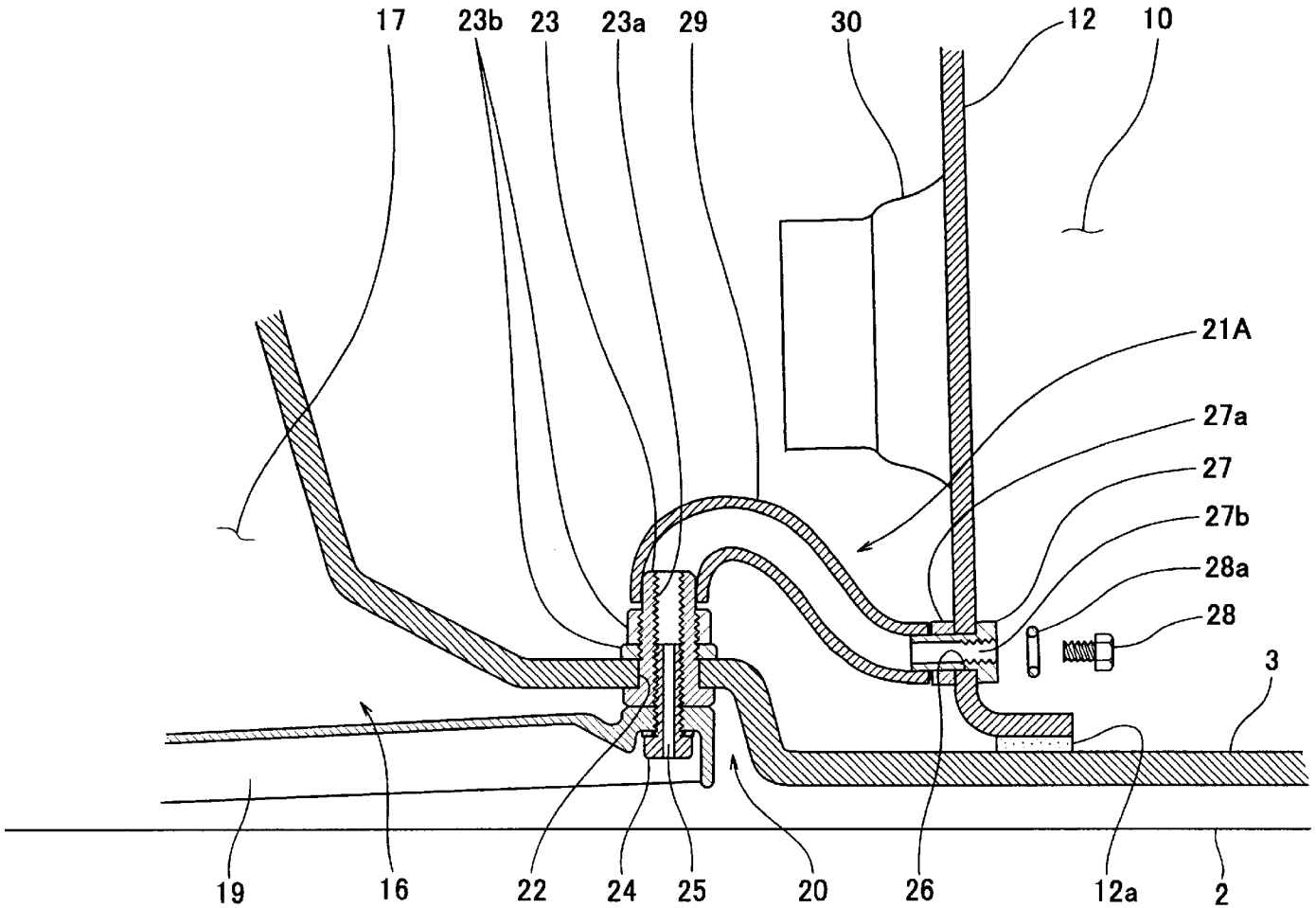
FIG. 4 is a cross-sectional view showing an example of a drain mechanism of the personal watercraft in FIG. 1.

A drain mechanism 21A shown in FIG. 4 uses a fastening member for mounting the grate member 19 to the concave portion 20. In general, the grate plate is mounted to the hull by means of a bolt and a nut. However, in this embodiment, first of all, a tubular bolt 23 with a head as a second pipe member is inserted into a penetrating hole 22 formed in the concave portion 20 in the direction from the outside toward the inside of the body 2. The tubular bolt 23 has an axial screw hole 23*a* penetrating inside thereof. Nuts 23*b* are screwed to the bolt 23 which is thereby secured to the hull 3 from inside the body 2. A drain plug 24 is screwed into the screw hole 23*a* in such a manner that the grate plate 19 is pressed between the drain plug 24 and an outer end face of the tubular bolt 23. A penetrating hole, i.e., a drain hole 25 is formed in the drain plug 24 along a center axis thereof. Meanwhile, a penetrating hole 26 for discharging water is formed in the vicinity of a lower end of the bulkhead 12. A substantially cylindrical fitting member 27 having an inner passage 27*b* for discharging water is mounted to the penetrating hole 26 by means of a nut 27*a*. A plug 28 for opening/closing the inner passage 27*b* of the fitting member 27 is screwed into the fitting member 27 from the direction of the engine room 10 side with a seal ring 28*a* retained between the fitting member 27 and the plug 28. A hose 29 as a first pipe member is connected to the fitting member 27 and the tubular bolt 23 to allow the fitting member 27 to communicate with the tubular bolt 23.

In FIG. 4, reference numeral 30 denotes a seal member for sealing a portion of the bulkhead 12 through which the propeller shaft 14(FIG. 2) penetrates. A seal material 12*a* is filled in a gap between the lower end of the bulk head 12 and the hull 3.

With the above configuration, when the watercraft 1 is beached, by putting the operator's hand into the engine room 10 and removing the plug 28, the water in the body 2 can be easily discharged. The discharge is facilitated by inclining the body 2 such that its front end is made higher. In this embodiment, as shown in FIG. 3, the grate plate 19 is mounted by the fastening members at two positions, and correspondingly, two drain mechanisms are formed at the same positions. Instead of two, the number of the drain mechanisms may be one, or three or more. The drain plug 24 having the drain hole 25 for mounting the grate plate 19 may be replaced by a solid bolt with head. Specifically, the bolt with head for mounting the grate plate 19 is used to close the drain passage, and the fitting member 27 on the bulkhead 12 side may be opened without the plug 28. In this case, the grate plate 19 is removed to discharge the water.

Figure 5:
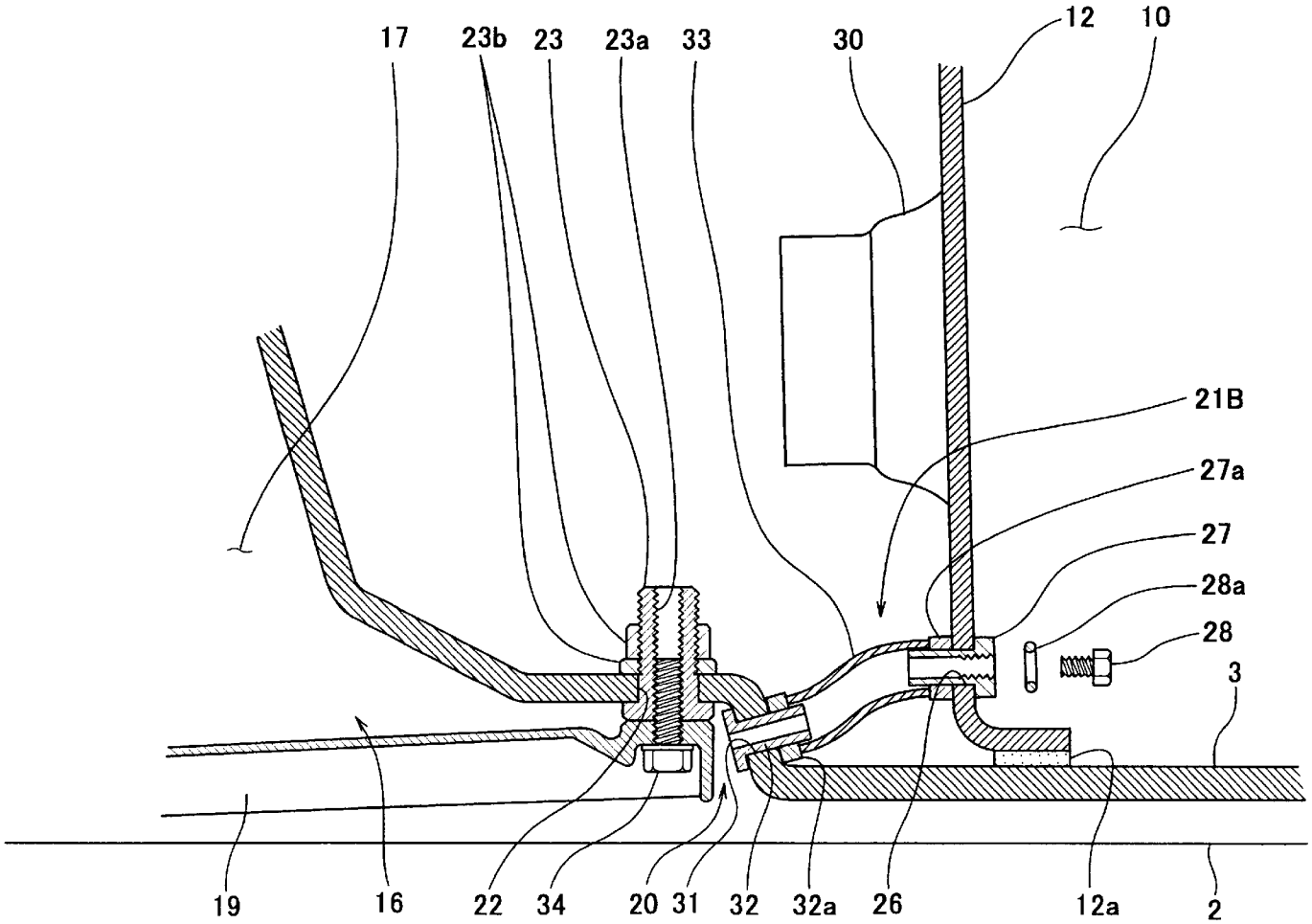
FIG. 5 is a cross-sectional view showing another example of the drain mechanism of the personal watercraft in FIG. 1.

FIG. 5 shows another drain mechanism 21B. The drain mechanism 21B uses a solid bolt 34 instead of the hollow drain plug 24 in FIG. 4. In FIG. 5, the same components as those of the drain mechanism 21A in FIG. 4 are identified by the same reference numerals and will not be further described.

The drain mechanism 21B comprises a penetrating hole 31 formed in a side wall portion of the concave portion 20 and a fitting member 32 mounted to the penetrating hole 31 by means of a nut 32*a*. The penetrating hole 26 for discharging water, which is the same as that shown in FIG. 4, is formed in the vicinity of the lower end of the bulk head 12. The fitting member 27 is mounted to the penetrating hole 26 by means of the nut 27*a*. The plug 28 is screwed into the fitting member 27 with the seal ring 28*a* retained between them. A hose 33 as the first pipe member is connected to the fitting member 27 and the fitting member 32 of the concave portion 20.

In accordance with the drain mechanism 21B, since bilge is discharged through a portion closer to the bottom than the drain mechanism 21A in FIG. 4, the bilge remaining in the body 2 can be lessened.

Figure 6:
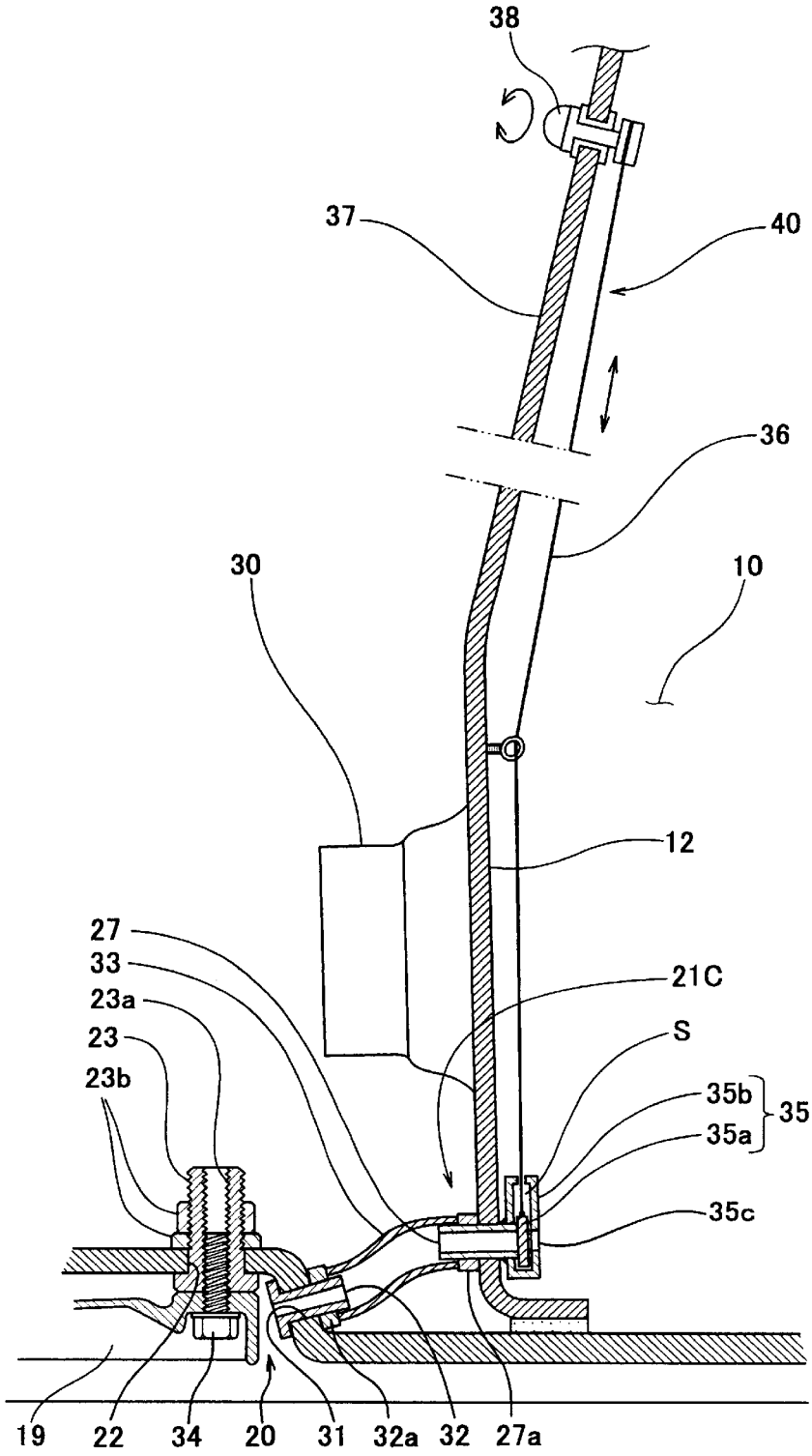
FIG. 6 is a cross-sectional view showing another example of the drain mechanism in FIG. 1.

FIG. 6 shows a more convenient drain mechanism 21C. The drain mechanism 21C is obtained by adding a remote operation means 40 for opening/closing the drain mechanism 21B in FIG. 5 by remote operation and an opening/closing means to be opened/closed by the remote operation means 40 to the drain mechanism 21B. In FIG. 6, the same components as those of the drain mechanism 21B in FIG. 5 are identified by the same reference numerals and will not be further described.

The drain mechanism 21C is configured such that a gate valve 35 having a simple structure is mounted as the opening/closing means at an end portion of the fitting member 27 of the bulkhead 12, which is located on the engine room 10 side, in the drain mechanism 21B in FIG. 5. The gate valve 35 comprises a valve disc 35*a* for opening/closing a tip end of the fitting member 27 and a valve body 35*b* that contains the valve disc 35*a* and a moving space S of the valve disc 35*a*. The valve body 35*b* is provided with an opening 35*c* through which an inside of the fitting member 27 communicates with the engine room 10 when the valve disc 35*a* is at an open position (at a position to which the valve disc 35*a* is moved to the upper side in the valve body 35*b*). Inside the valve body 35*b*, a rail (not shown) is provided to guide the valve disc 35*a* to move in sliding contact with an end face of the fitting member 27. As one of components of the remote operation means 40, a push-pull cable 36 is employed as a transmission member for transmitting an opening/closing force to the valve disc 35*a*. The push-pull cable 36 extends to an operation panel 37 of the deck 4 and is connected to an opening/closing operation knob 38 provided in the operation panel 37. A leading pipe of the push-pull cable 36 is fixed to a proper position of the valve body 35*b* of the gate valve 35, the bulkhead 12, or the like. The opening/closing operation knob 38 is operated to cause the push-pull cable 36 to be pushed/pulled, thereby causing the gate valve 35 to be opened/closed. The placement of the opening/closing operation knob 38 and the operation panel 37 will be better understood with reference to FIGS. 6 and 1.

The gate valve 35 may be replaced by a known cock. In this case, the push-pull cable 36 may be connected to an operation lever of the cock. Alternatively, the push-pull cable 36 may be replaced by a rod.

The drain mechanism 21C is obtained by adding the remote operation means 40 to the drain mechanism 21B in FIG. 5. As a matter of course, the remote operation means 40 is easily mounted to the drain mechanism 21A in FIG. 4.

In the above embodiments, the drain mechanism 21 is provided by using the fastening device of the grate plate 19 or the concave portion 20 for mounting the grate plate 19 rather than on the planing surface of the hull 3. Thus, preferably, the drain mechanism 21 is positioned so as not to affect cruising capability. Nonetheless, the drain mechanism may be provided on the planing surface when the planing of the watercraft is little affected by the drain mechanism.

Figure 7:
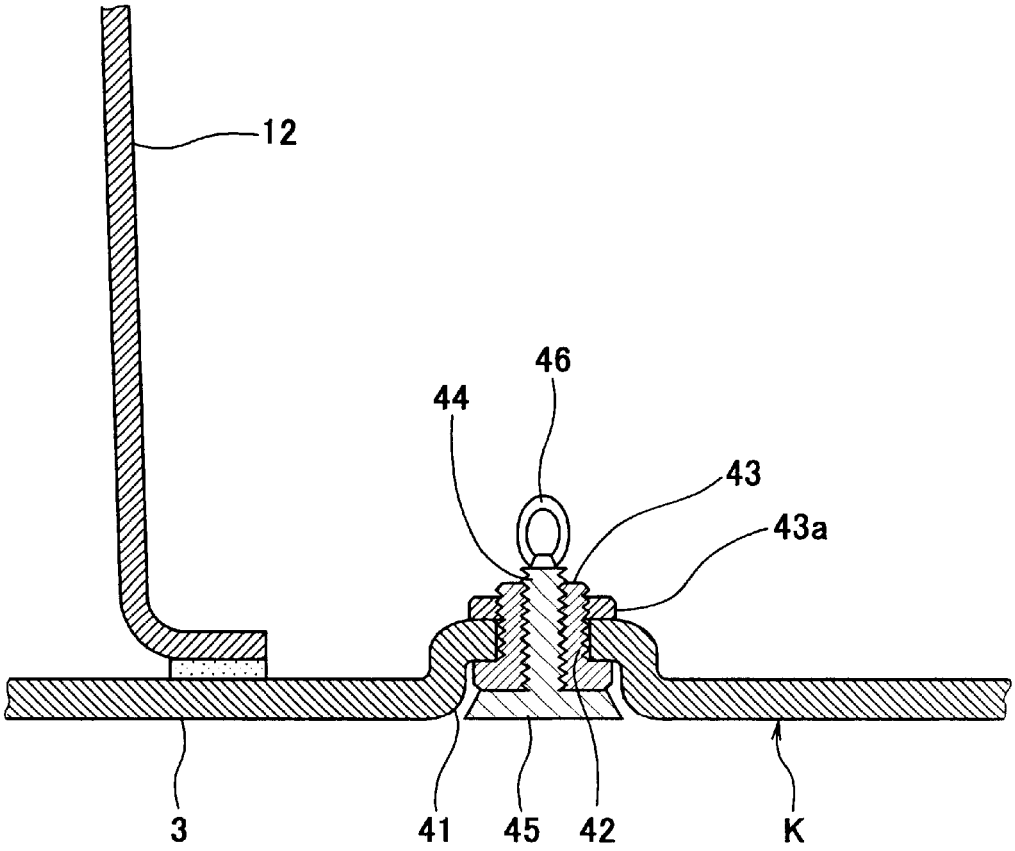
FIG. 7 is a cross-sectional view showing another example of the drain mechanism of the personal watercraft in FIG. 1.

For example, as shown in FIG. 7, a concave portion 41 is formed in the hull 3 at the bottom of the engine room 10, a penetrating hole 42 is formed in a top portion of the concave portion 41, and a bolt 43 having an internal thread inside thereof is inserted into the penetrating hole 42 and fixed by means of a nut 43*a* to the top portion of the concave portion 41. Also, a closing plug 44 is screwed into the bolt 43. A flat flange 45 is provided at one end portion of the closing plug 44 in such a manner that the flange 45 is substantially coplanar with a planing surface K in the state in which the closing plug 44 is screwed into the bolt 43. Specifically, by bringing the flat flange 45 into contact with the bolt 43, the flat flange 45 is positioned so that its surface is substantially coplanar with the planing surface K. A ring-shaped grip 46 is provided at the other end portion of the closing plug 44 on the engine room 10 side, for fastening/loosening the closing plug 44. The ring-shaped grip 46 is sized to pass through an inside of the internal thread of the bolt 43. With this configuration, the closing plug 44 can be opened/closed by using fingers or a simple jig from inside the body 2. However, this configuration is intended to be illustrative and not to be limiting of the present invention. For example, the configuration for opening/closing the closing plug from outside the body 2 can be easily achieved.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A stand-up type personal watercraft comprising:

an engine;

a body constituted by a deck and a hull, so as to form a space inside thereof;

an engine room for containing the engine;

a bulkhead that defines a front portion of the space in the body as the engine room; and a drain passage connecting a lower portion of the engine room with an outside of the watercraft so as to enable fluid communication therebetween, wherein the drain passage is adapted to be opened/closed.

2. The stand-up type personal watercraft according to claim 1, further comprising:

a water jet pump driven by the engine; and a water intake formed in the hull, through which water is sucked by the water jet pump, wherein one end of the drain passage is opened in the vicinity of the water intake.

3. The stand-up type personal watercraft according to claim 2, further comprising:

a grate plate, wherein a concave portion for mounting the grate plate is formed in a portion of the hull at a periphery of the water intake, a first penetrating hole is formed in the concave portion and a second penetrating hole is formed in a lower portion of the bulk head, and the drain passage is formed such that the first penetrating hole and the second penetrating hole are connected to each other by a first pipe member.

4. The stand-up type personal watercraft according to claim 3, wherein the drain passage has an openable closing member in at least one of an end portion thereof on the concave portion side and an end portion thereof on the bulkhead side.

5. The stand-up type personal watercraft according to claim 4, wherein the end portion of the drain passage on the concave portion side is opened, and the drain passage has the closing member in the end portion thereof on the bulkhead side, the watercraft comprising:

a transmission member connected to the closing member and extending to the deck, for opening/closing the closing member; and an operation member mounted to the deck, for operating the transmission member.

6. The stand-up type personal watercraft according to claim 3, further comprising:

a fastening member provided for mounting the grate plate to a portion of the hull at a periphery of the water intake, wherein the fastening member is comprised of a second pipe member having a penetrating hole inside thereof and mounted to the concave portion and a drain plug removably attached in the penetrating hole of the second pipe member with the grate plate retained between the end portion of the second pipe member and the drain plug, and one end portion of the first pipe member is connected to the second pipe member.

7. The stand-up type personal watercraft according to claim 6, wherein the drain passage has an openable closing member in an end portion thereof on the bulkhead side, and the drain plug has a hollow portion through which an inside of the second pipe member communicates with an outside of the watercraft.

8. A stand-up type personal watercraft comprising:

an engine;

a body including a deck and hull;

an engine room configured to contain the engine;

a bulkhead that defines a front portion of the body as the engine room;

a drain passage formed in a lower portion of the engine room so as to communicate with an outside of the watercraft, said drain passage being adapted to be opened/closed;

a water jet pump driven by the engine;

a water intake formed in the hull, through which water is sucked by the water jet pump; and a grate plate;

wherein a concave portion for mounting the grate plate is formed in a portion of the hull at a periphery of the water intake;

wherein a first penetrating hole is formed in the concave portion and a second penetrating hole is formed in a lower portion of the bulkhead; and wherein the drain passage is formed such that the first penetrating hole and the second penetrating hole are connected to each other by a first pipe member.

9. The stand-up type personal watercraft according to claim 8, wherein the drain passage has an openable closing member in at least one of an end portion thereof on the concave portion side and an end portion thereof on the bulkhead side.

10. The stand-up type personal watercraft according to claim 9, wherein the end portion of the drain passage on the concave portion side is opened, and the drain passage has the closing member in the end portion thereof on the bulkhead side, the watercraft comprising:

a transmission member connected to the closing member and extending to the deck, configured to open/close the closing member; and an operation member mounted to the deck, configured to operate the transmission member.

11. The stand-up type personal watercraft according to claim 8, further comprising:

a fastening member provided for mounting the grate plate to a portion of the hull at a periphery of the water intake;

wherein the fastening member is comprised of a second pipe member having a penetrating hole inside thereof and mounted to the concave portion and a drain plug removably attached in the penetrating hole of the second pipe member with the grate plate retained between the end portion of the second pipe member and the drain plug; and wherein one end portion of the first pipe member is connected to the second pipe member.

12. The stand-up type personal watercraft according to claim 11, wherein the drain passage has an openable closing member in an end portion thereof on the bulkhead side, and the drain plug has a hollow portion through which an inside of the second pipe member communicates with an outside of the watercraft.

* * * * *